US005099134A

United States Patent [19]

Hase et al.

[11] Patent Number: 5,099,134

[45] Date of Patent: Mar. 24, 1992

[54] COLLIMATOR AND A METHOD OF PRODUCING A COLLIMATOR FOR A SCINTILLATOR

[75] Inventors: Daisuke Hase, Kanagawa; Takayuki Satoh, Shizuoka; Kenji Ushimi, Kanagawa, all of Japan

[73] Assignee: Kabushiki Kaisha Toshiba, Kawasaki, Japan

[21] Appl. No.: 538,763

[22] Filed: Jun. 15, 1990

[30] Foreign Application Priority Data

May 27, 1988 [JP] Japan ..... 63-128433
Mar. 28, 1989 [JP] Japan ..... 1-73917
Oct. 4, 1989 [JP] Japan ..... 1-257733

[51] Int. Cl.[5] ..... G21K 1/02

[52] U.S. Cl. ..... 250/505.1; 250/363.10; 378/149; 378/154

[58] Field of Search ..... 250/505.1, 363.10; 378/149, 154, 147; 156/222, 197

[56] References Cited

U.S. PATENT DOCUMENTS 2,983,640 5/1961 Knoll et al. ..... 156/197
3,143,652 8/1964 Bigelow ..... 378/147
3,936,340 2/1976 Muehllehner ..... 250/363.1
3,943,366 3/1976 Platz et al. ..... 250/363.1
3,988,589 10/1976 Leask ..... 250/363.1
4,047,037 9/1977 Schlosser et al. ..... 250/363.1
4,081,687 3/1978 York et al. ..... 378/149
4,450,706 5/1984 Engelmohr ..... 378/149
4,500,380 2/1985 Bova ..... 156/222

*Primary Examiner*—Jack I. Berman
*Attorney, Agent, or Firm*—Oblon, Spivak, McClelland, Maier & Neustadt, P.C.

[57] ABSTRACT

A collimator for a scintillator, having a number of through holes formed side by side, each for guiding and passing radiation from one end thereof to an other end and focusing the radiation at a predetermined position, including a frame made of a radiation shielding material, and defining a radiation transparent field of view, and a septa section provided in a lattice form in the field of view so as to define the through holes. The septa section includes a plurality of first partition plates arranged at substantially equal intervals and a plurality of second partition plates crossing the first partition plates in a lattice form. The first and second partition plates are made of a material, preferably tungsten or lead alloy, that sheilds the radiation. A plurality of focused slits are formed in at least either the first or second partition plates with the other partition plates being fitted in the slits.

28 Claims, 17 Drawing Sheets

FIG.8
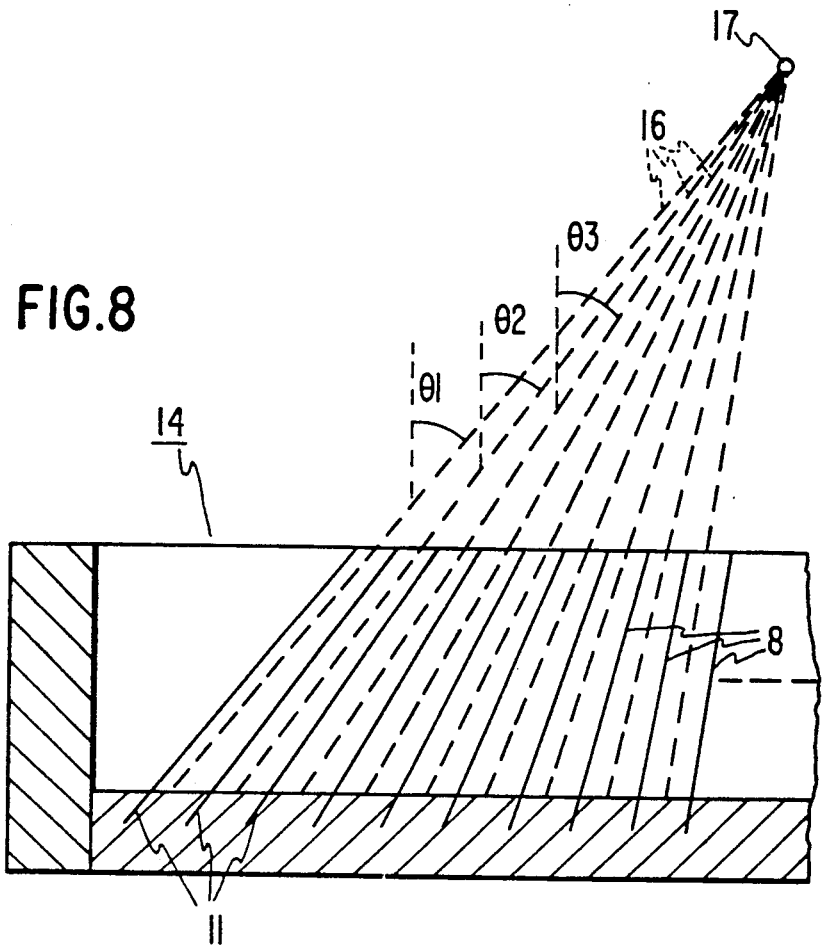
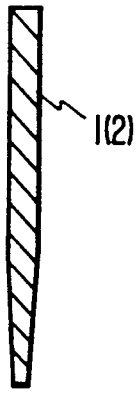
FIG.7a
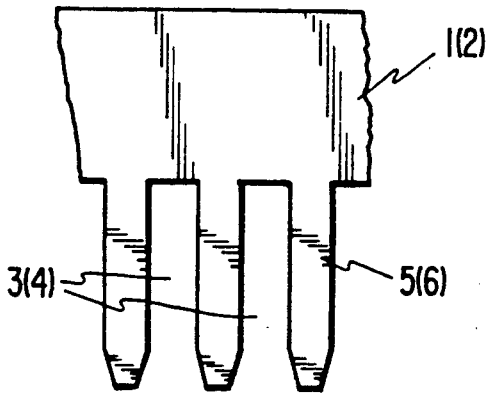
FIG.7b

COLLIMATOR AND A METHOD OF PRODUCING A COLLIMATOR FOR A SCINTILLATOR

BACKGROUND OF THE INVENTION

1. Field of the Invention

The present invention relates to a collimator and a method of producing a collimator for a scintillator.

2. Discussion of the Background

In recent diagnosis of diseases, much weight is given to the role of an imaging diagnosis using an X-ray photograph, an X-ray CT image, a scintigram by radio isotope (RI), an ultrasonic image, a positron CT image, a thermogram, a nuclear magnetic resonance (NMR) image, or the like. Of those, the RI-oriented scintigram is an extracted image of RI in a body. A scinticamera is a device for acquiring such a scintigram. This scinticamera detects radiation given in a body by a large circular scintillator, a number of photomultiplier tubes, a computer, etc. A honeycomb perforated collimator is provided next to the scintillator to detect radiation from a target organ as much as possible at high sensitivity.

Such a collimator has, for example, 2000 to 4000 regular hexagonal holes regularly formed therein, and is made of lead. The axes of these holes are set to be normal to a focus line. These holes are formed by setting taper pins with a regular hexagonal cross section upright, introducing melted lead and pulling out the taper pins after the lead becomes solid. It is desirable that septa constituting boundary portions of the holes are thinner (equal to or less than 0.2 mm) in order to improve the resolution. If the thicknesses of septa are set equal to or less than 0.2 mm, however, a molten metal may not stir at the time of casting or the holes may be deformed or the septa may be damages when pulling out the pins. Furthermore, the collimator having even one defective portion cannot be used as a product and is difficult to repair, thus significantly reducing the yield.

SUMMARY OF THE INVENTION

Accordingly, one object of this invention is to provide a new and improved collimator and method of making a collimator with a thin septa layer of 2 mm or less, in which no damage or deformation occurs to the septa during manufacturing.

Another object of this invention is to provide a new and improved collimator and method of making a collimator whereby improved high sensitivity and high resolution are simultaneously achieved.

Yet another object of this invention is to provide a novel method of making a collimator whereby the manufacturing yield is improved.

Still a further object of this invention is to provide a new and improved fan beam collimator, and method of making, having thin septa layers and exhibiting improved high sensitivity, and high resolution.

These and other objects are achieved according to a preferred embodiment of the present invention by providing a new and improved collimator including first and second parallel arrays of radiation shielding longitudinally extending comb-shaped plates, wherein each plate of each array includes plural slits extending from one edge of the plate to a predetermined distance at predetermined angles toward an opposite edge of the plate, and the plates of the first array are arranged orthogonal to the planes of plates of the second array with the slits of the plates of the second array intermeshed with the slits of the first array to define plural radiation passages between adjacent plates of the first array and intermeshing adjacent plates of the second array. Preferably the plates of both arrays are made of annealed tungsten or lead alloy and the slits are formed by precision wire electric discharge machine (WEDM) under computer control. Preferably the tips of each comb element defined between adjacent slits of the array plates are two dimensionally tapered to facilitate ease of assembly during intermeshing of the plates of the two arrays.

In a preferred embodiment the slits of the first array of comb-shaped plates are formed at respective predetermined angles focused on a common focus line, so that when the plates of the second array are intermeshed with the plates of the first array, a fan beam collimator focused on the focus line is provided.

In another embodiment of the present invention first and second arrays of radiation shielding plates are provided, but only the plates of a selected of the first and second arrays are provided with slit holes at a predetermined angle with respect to the edges of the plates of the selected array, and the plates of the second array, which are not provided with slits, are inserted in the slit holes of the plates of the selected array to constitute a lattice-formed septa section. The slits holes of the plates of the first array can be angled to focus on a focus line, thereby to provide a fan-beam collimator upon insertion of the plates of the second array in corresponding slit holes of the first array. In this embodiment, the slit holes are formed by press punching to improve manufacturing productivity but computer controlled WEDM is also possible.

In yet another embodiment, a collimator having honeycomb shaped radiation passing through holes is provided. According to this embodiment of the present invention, there is provided a method of producing a collimator having through holes with a diameter of 3 mm or less defines in a honeycomb form with the septa thickness being 0.2 mm or less, wherein collimators can be produced efficiently without damaging or deforming septa by forming the through holes using plates with a thickness of 0.2 mm or less made of a material that shields radiations, and subjecting the plates to press working to form groove-shaped recesses before they are securely stacked, or alternatively, adhesive films on the plates in a stripe form, securely stacking the plates with adhesive films, then pulling the plates in a stacking direction to cause deformation, or otherwise assembling the plates in a lattice form.

The present invention further includes a new and improved method for forming the collimator of the first embodiment, including providing a hard lead frame having an opening defining a useful field of view, forming grooves in opposed sides of the frame opening in correspondence with a desired spacing between adjacent plates of the first and second arrays of plates, and inserting the first and second arrays of plates in the respective opposed grooves in the frame, with the slits of the plates of the first and second arrays intermeshed. Alternatively, a steel frame is provided with appropriately spaced grooves surrounding a desired field of view, the arrays of plates are mounted intermeshed and supported on the frame, and outside and around the perimeter of the field of view soft lead clay is inserted between the plates of the arrays, thereby providing an opaque border surrounding the field of view and maintaining the rigidity of the collimator plates upon hardening of the soft lead clay.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Figure 9:
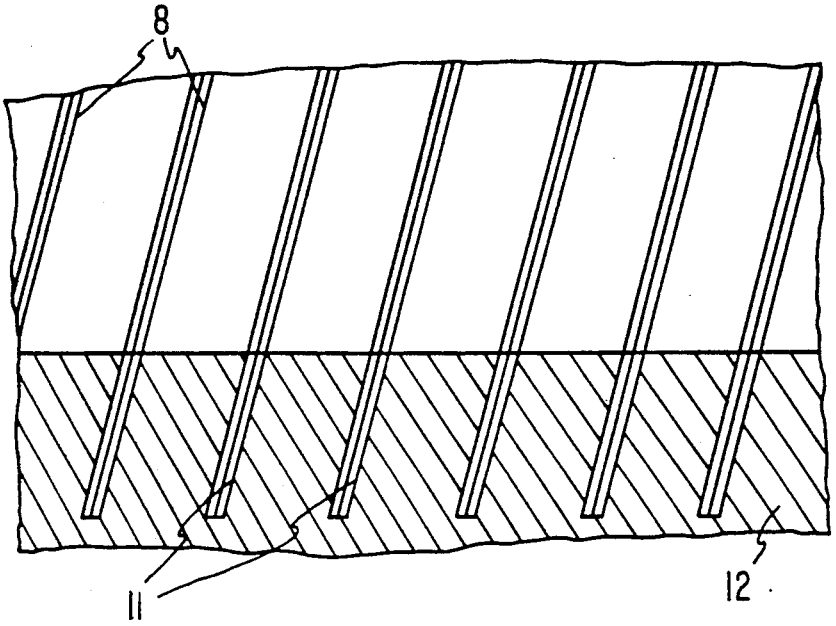
Figure 10:
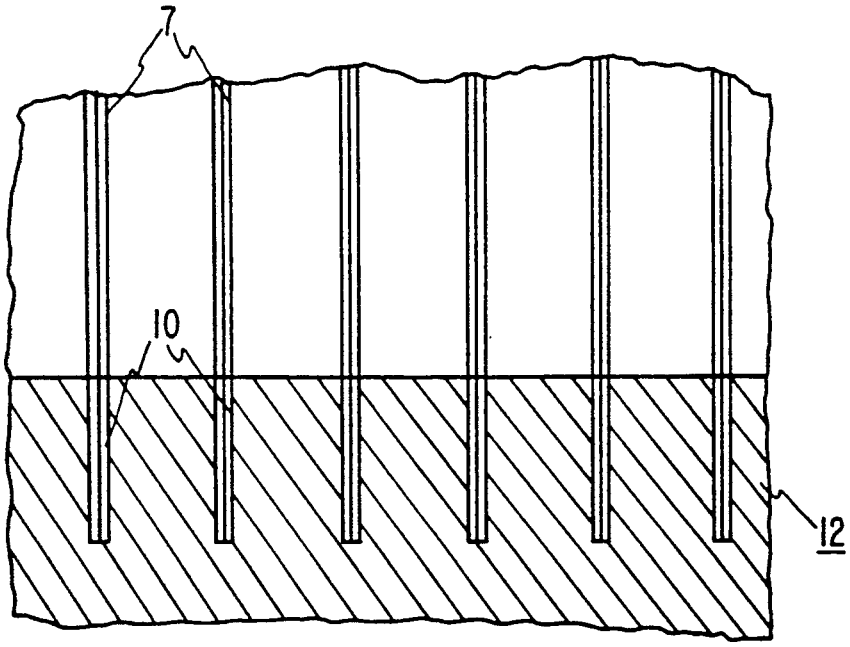
Figure 17:
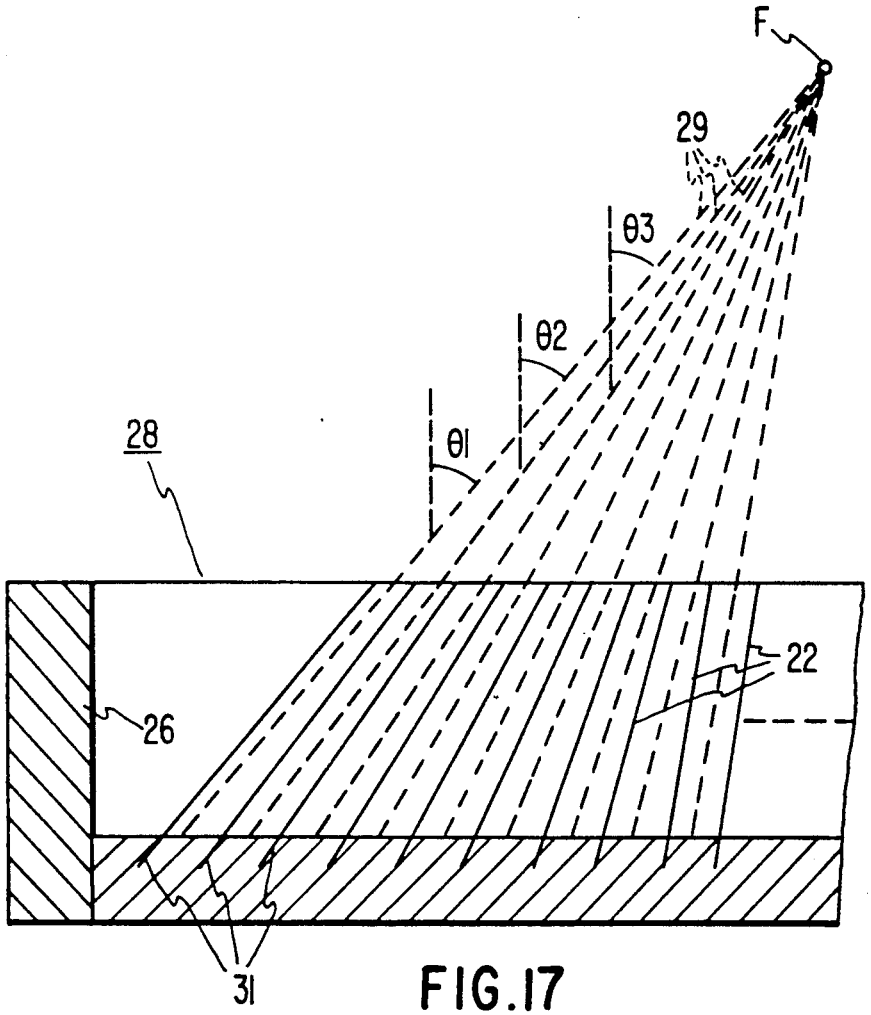
Figure 28:
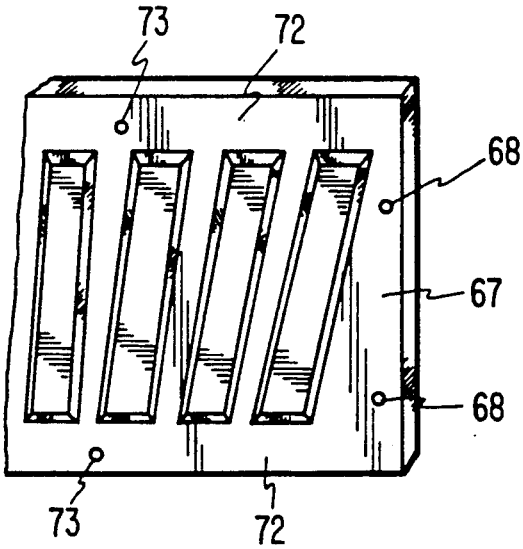
Figure 24:
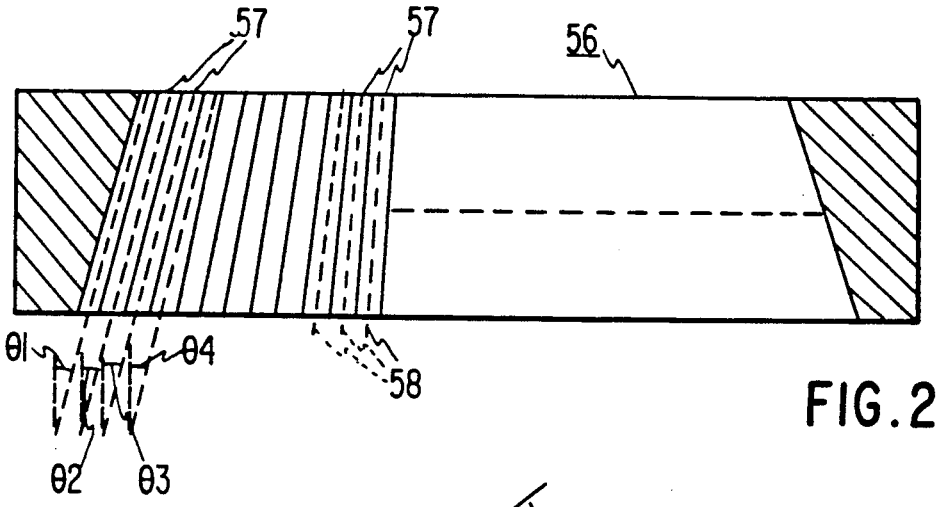
Figure 25:
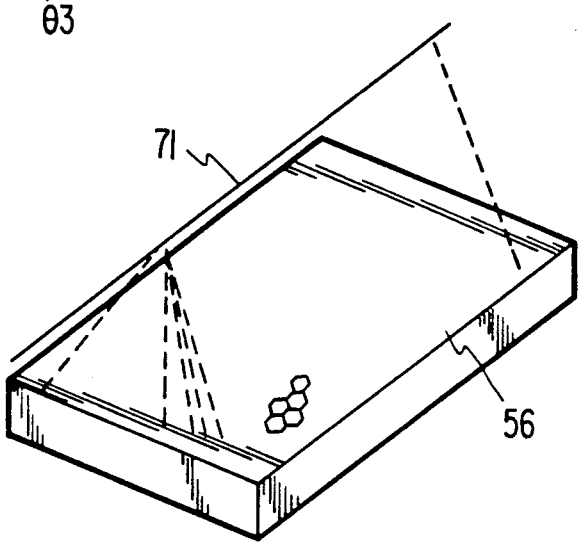
Figure 29A:
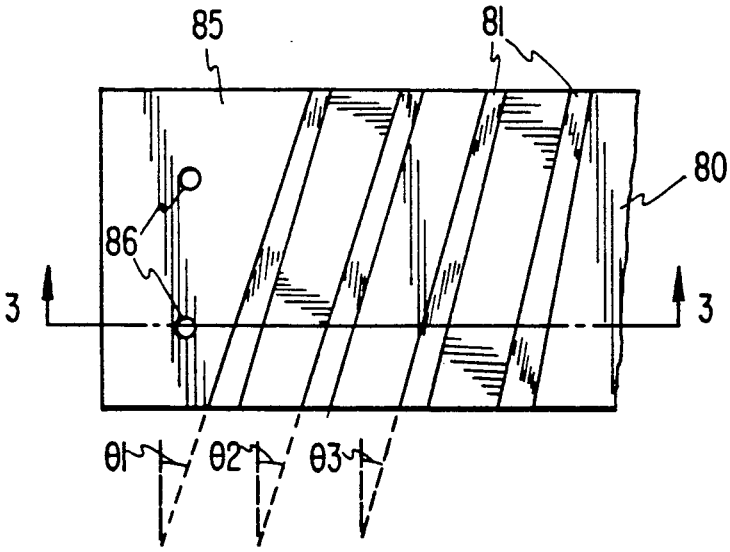
Figure 29B:
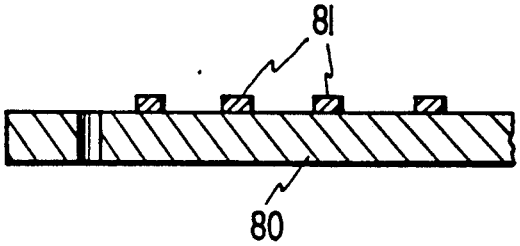
Figure 32:
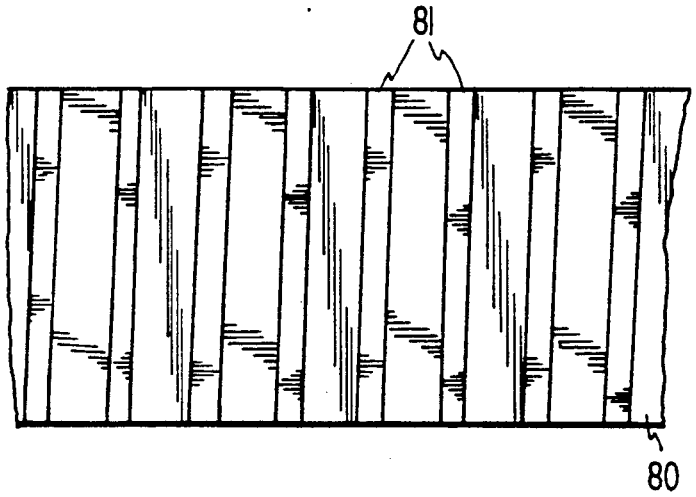
Figure 33:
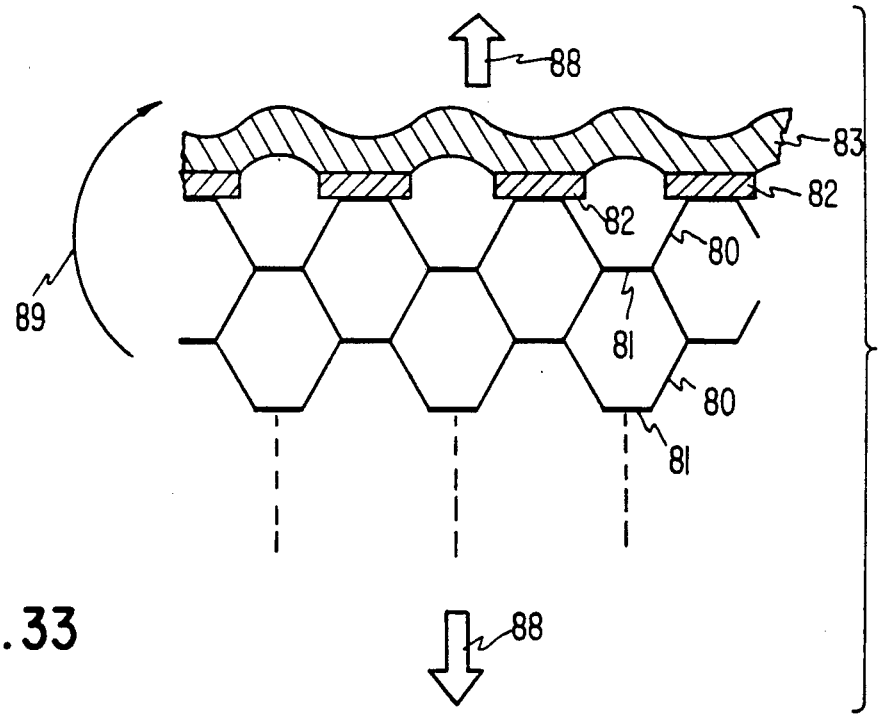
Figure 38:
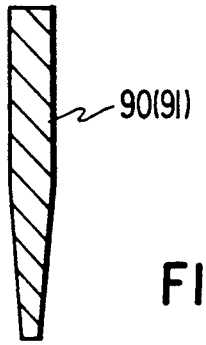
Figure 30:
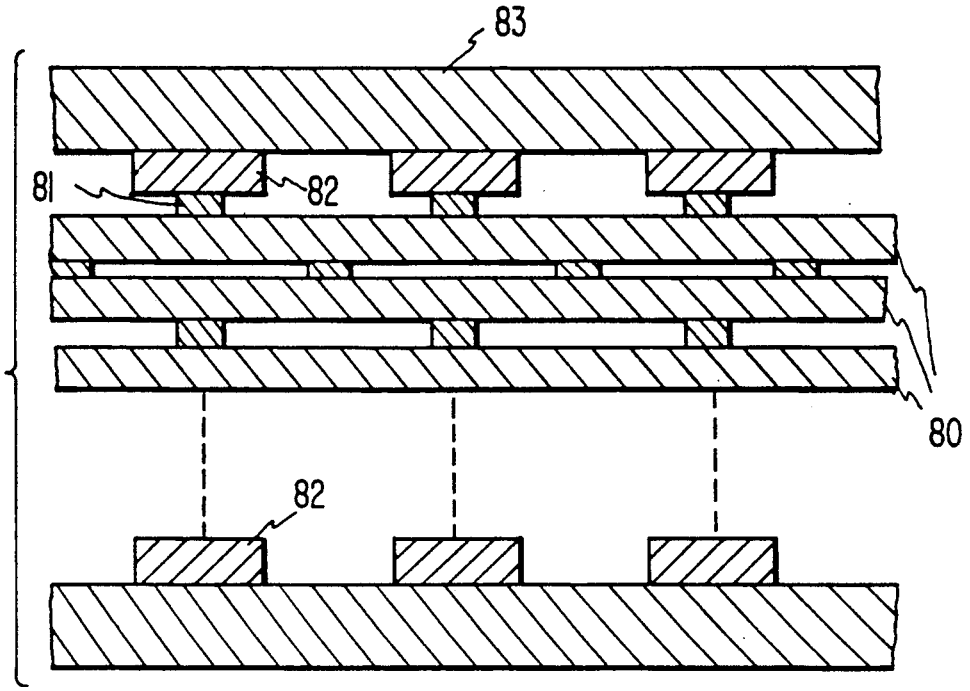
Figure 31:
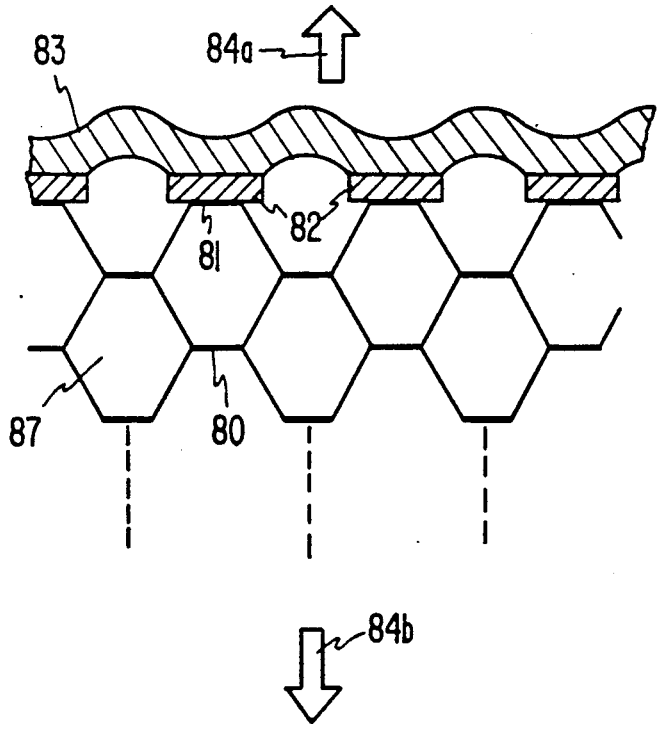
Figure 34:
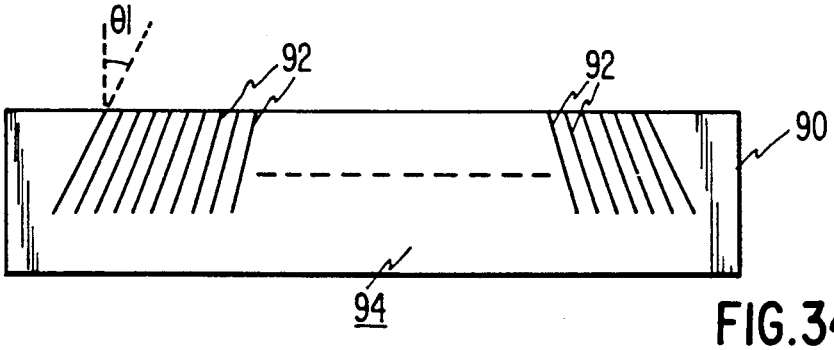
Figure 35:
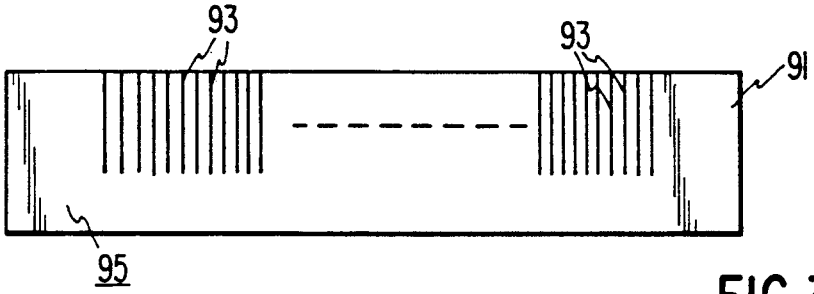
Figure 36:
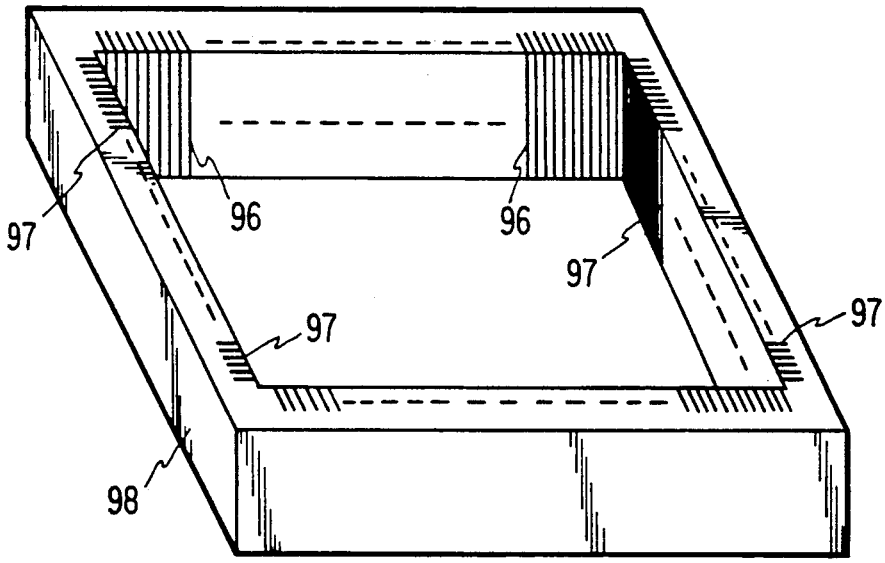
Figure 39:
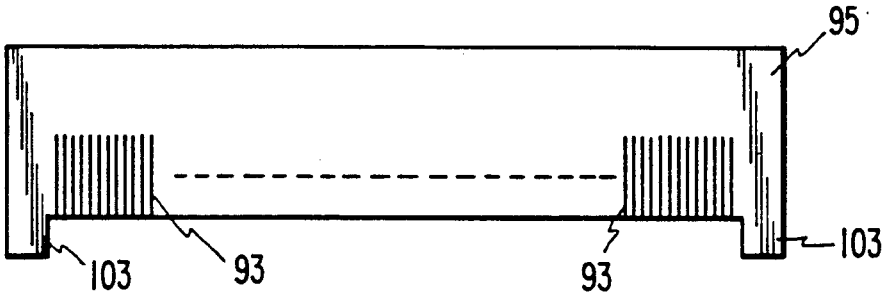
Figure 37:
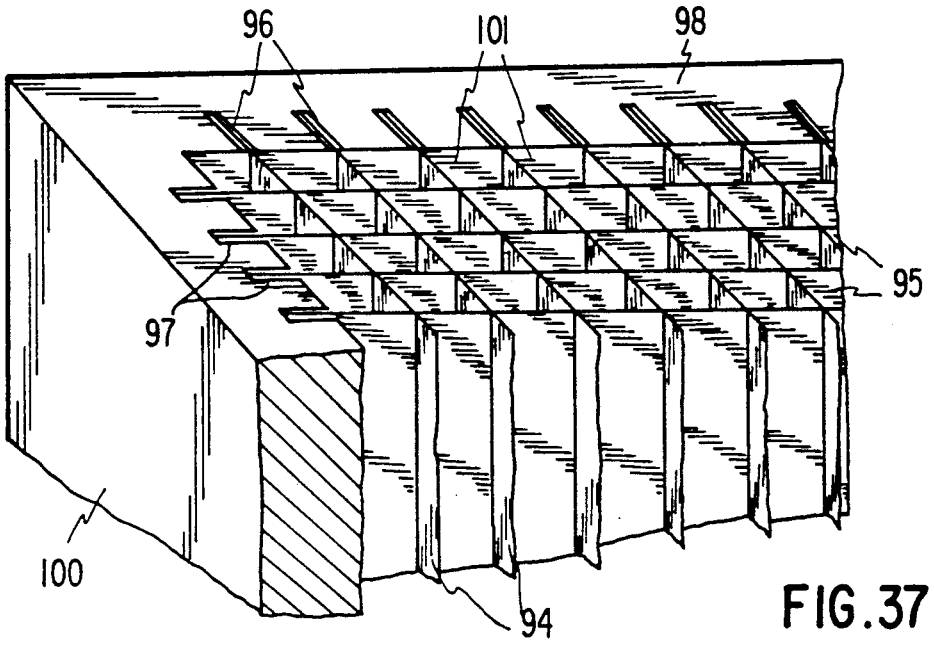
Figure 40:
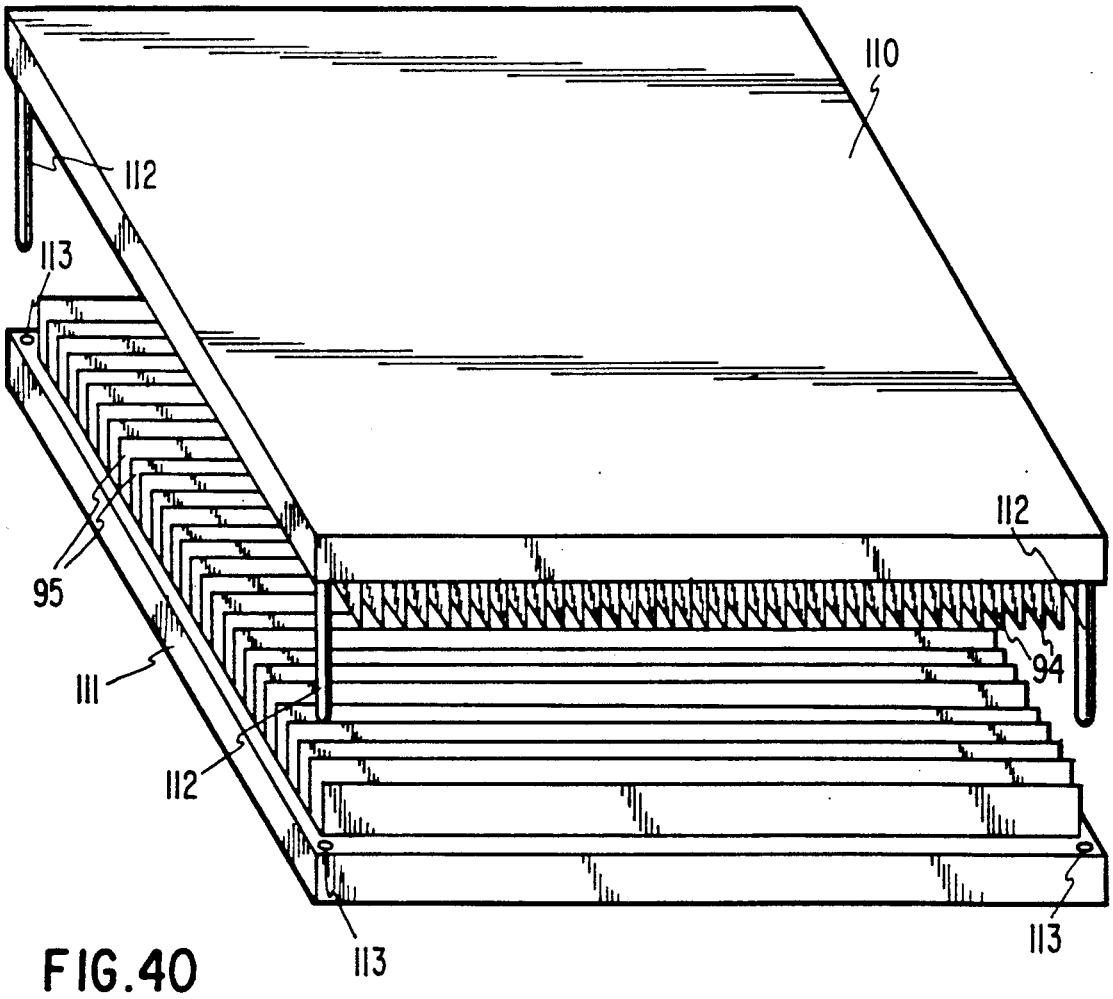

FIG. *7a* is an end view of a comb-shaped plate of the first embodiment;

FIG. *7b* is side view illustrating plural comb elements of a comb-shaped plate of the first embodiment;

FIG. 8 is a side view, partially in cross-section illustrating the focusing enabled by the fan-shaped collimator according to the first embodiment;

FIGS. 9 and 10 are side and end views, respectively, illustrating assembly of the plates of the fan-shaped collimator in the end frame element;

FIGS. 11 through 16 are diagrams for explaining a second embodiment of a perforated collimator according to the present invention and a method of producing the same;

FIG. 17 is a diagram for explaining the second embodiment of a perforated collimator according to this invention;

FIGS. 18 through 27 are illustrations for explaining another embodiment of a collimator producing method according to the present invention;

FIG. 28 is an illustration illustrating a modification of the embodiment described with respect to FIGS. 18–27;

FIGS. 29 through 31 are illustrations for explaining a further embodiment of a collimator producing method according to this invention;

FIGS. 32 and 33 are illustrations illustrating a modification of this further embodiment;

FIGS. 34 through 38 are illustrations for explaining yet a further embodiment of a collimator producing method according to this invention; and FIGS. 39 and 40 are illustrations of a modification of the embodiment shown in FIGS. 34–38.

DESCRIPTION OF THE PREFERRED EMBODIMENTS

Figure 1:
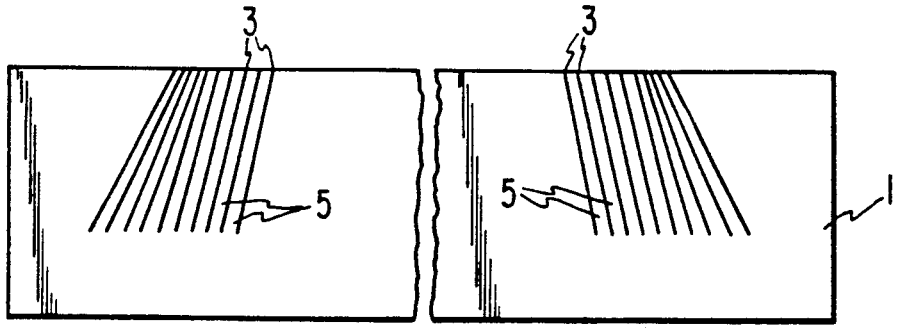
FIG. 1 is a side view of one of the plates of the first array of plates of a fan-shaped collimator according to a first embodiment of the present invention.
Figure 2:
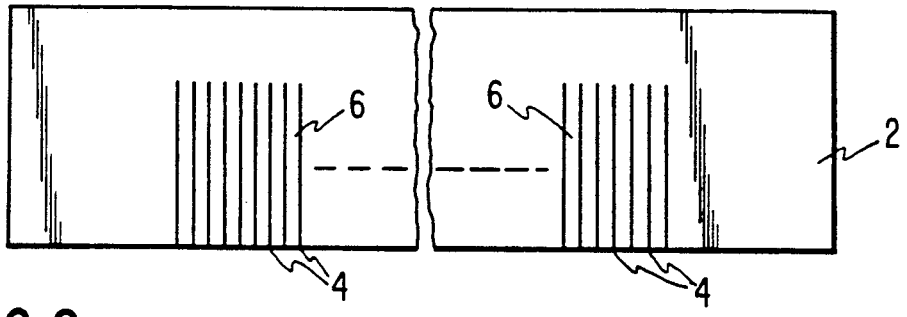
FIG. 2 is a side view of one of the plates of a second array of plates of the fan-shaped collimator according to the first embodiment.

Referring now to the drawings, wherein like reference numerals designate identical or corresponding parts throughout the several views, and more particularly to FIGS. 1 and 2 thereof, there is shown collimator rectangular partition plates 1 and 2 having linear slits 3 and 4, respectively, so as to define plural comb elements 5 and 6, respectively, between the slits 3 and 4, respectively. Although the plates 1 and 2 are shown as having roughly equal widths, the widths of the two plates can be different. In a preferred embodiment, the plates 1, 2 are made of annealed tungsten, but lead alloy, carbon fiber reinforced lead, or thin steel septa laminated with radiation shielding material such as lead can be employed, so long as the finished plates have sufficient opacity and sufficient rigidity to maintain their shapes during assembly and operation.

As shown in FIG. 1, the slits 3 in plate 1 are formed at predetermined angles with respect to the edges of the plate 1 to achieve focusing in the assembled fan-beam collimator. The slits 4 of plate 2 are formed perpendicular to the edges of plate 2. In a preferred method, the slits 3 and 4 are formed by computer controlled WEDM in tungsten plates having a thickness of 0.1 to 0.2 mm. Typically, several hundred of the plates 1 and several hundred of the plates 2 are provided with the plates 1 and 2 arranged in respective parallel arrays and intermeshed by means of the slits 3 and 4.

Figure 3:
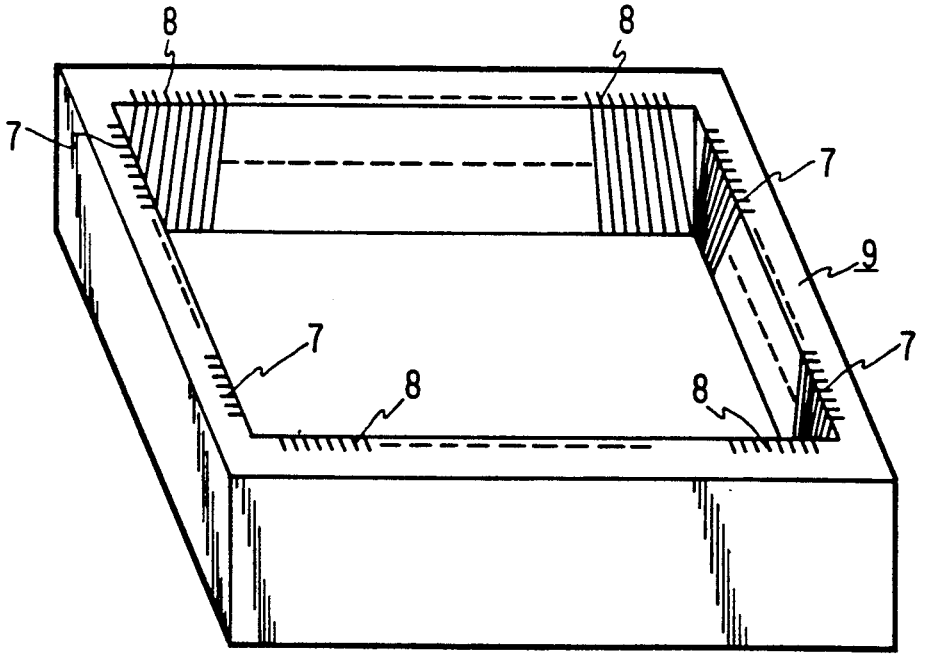
FIG. 3 is a perspective view illustrating a peripheral frame element for assembly of the first and second arrays of plates of the fan-shaped collimator according to the first embodiment.
Figure 4:
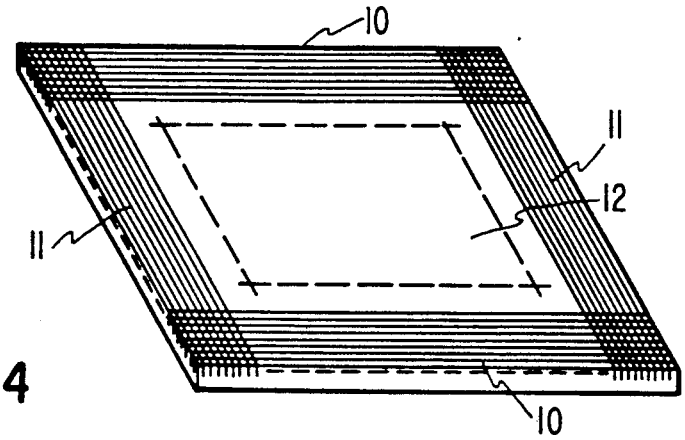
FIG. 4 is a perspective view of an end frame element for assembly of the first and second arrays of plates of the collimator of the first embodiment.
Figure 5:
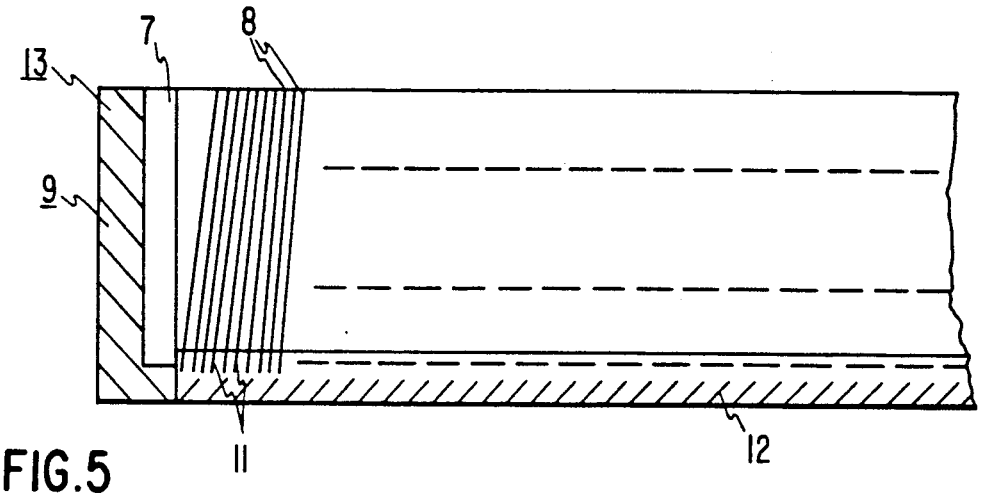
FIG. 5 is a side view in cross-section of the assembled frame elements shown in FIGS. 3 and 4.
Figure 6:
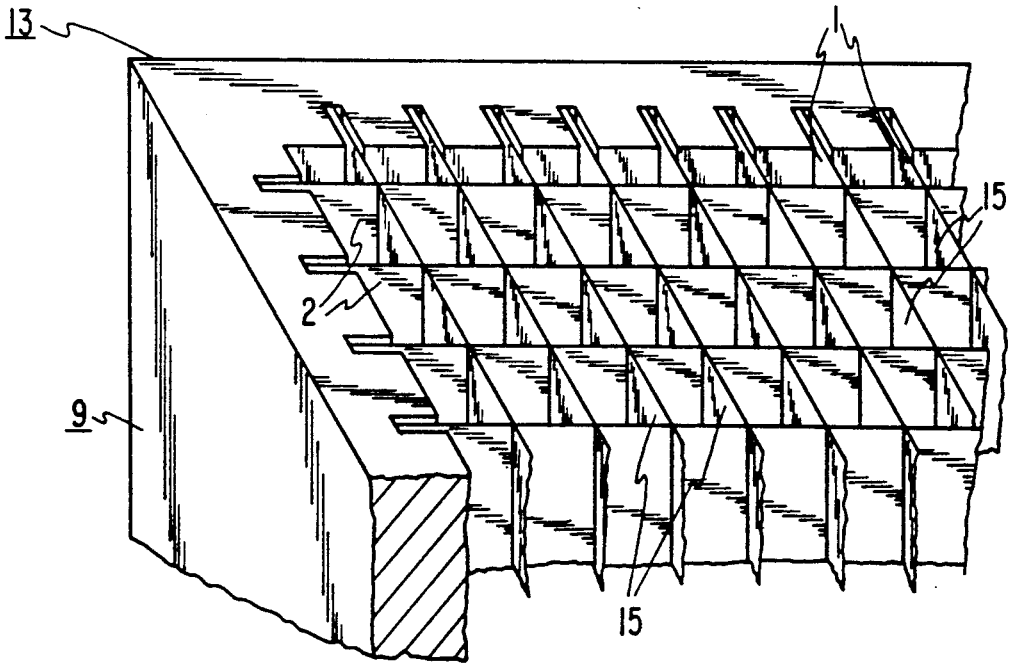
FIG. 6 is a fragmentary perspective view of a corner of the assembled collimator according to the first embodiment.
Figure 11:
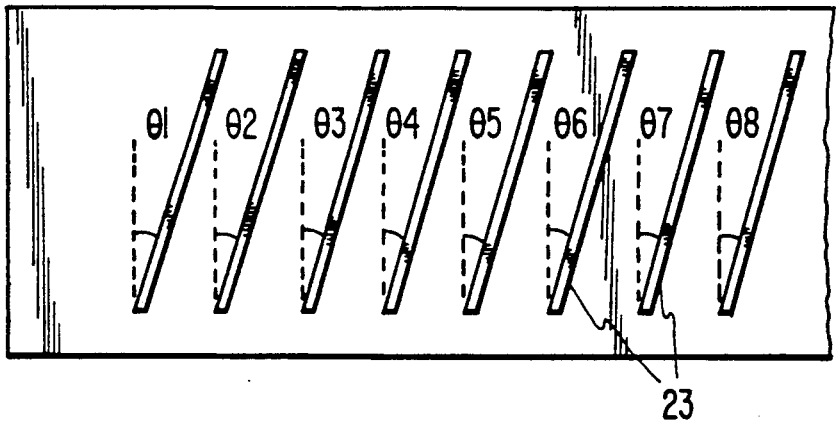
Figure 12:
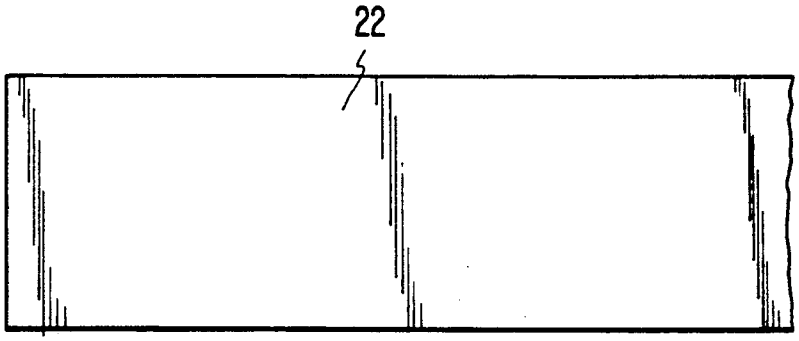
Figure 14:
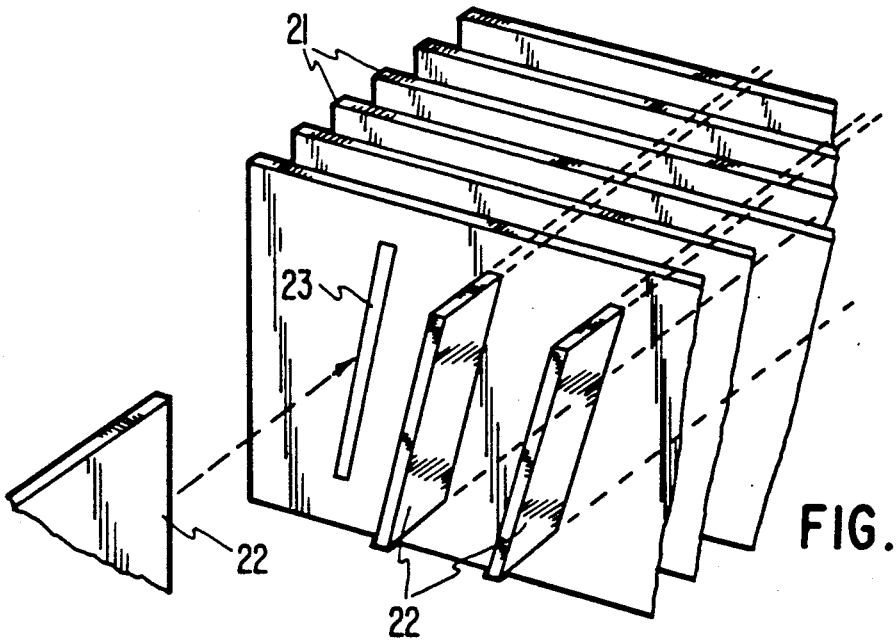

In one embodiment, the plates 1 and 2 are assembled intermeshed by means of the frame elements 9 and 12 shown in FIGS. 3–6. Box frame element 9 is radiation shielding and has plural opposed grooves 7 and 8 formed in inner walls thereof and in which the plates 1 and 2 are respectively fitted. Also provided is a radiation transparent frame bottom element 12 having grooves 10 and 11 in which the plates 1 and 2 are to be inserted. In this embodiment, the frame bottom element 12 is soldered to the box frame element 9 with the grooves 10 and 11 aligned with the corresponding grooves 7 and 8 to form a box-shaped frame body 13. Then, in assembly, the plates 1 are fitted in the grooves 7 and 10, and the plates 2 are fitted in the grooves 8 and 11 and intermeshed with the plates 1 by means of the respective slits 3 and 4. As shown in FIGS. 3 and 4, the grooves 8 and 11 are angled or "focused" in correspondence with the focusing defined by the angles of slits 3.

In an alternate method, a steel frame preferably but not necessarily provided with grooves for fitting of plates 1 and 2, is provided to support the plates 1 and 2. For example, the steel frame can have a shape corresponding to the desired field of view with an opening sized accordingly. Each plate 1 then may have lower end corners removed so that the plates 1 fit inside the frame opening with the lower end corners thereof flush with the frame, whereby the upper end portions of the plates 1 rest on and are supported by the steel frame. If grooves are provided in the frame, then the end corner portions of the plates 1 may also be fitted in such grooves. Plates 2 are then intermeshed with the plates 1 by means of the slits 3 and 4. Thereafter, a soft lead clay is applied between the plates 1 and 2 around and outside the field of view and allowed to harden, thereby maintaining rigidity of the collimator.

Alternatively, in constructing the fan beam collimator of the first embodiment, a hard lead frame, again sized and spaced in accordance with the required field of view, and having appropriately spaced and angled grooves for fitting of the plates 1 and 2 can be used.

Although the first embodiment is described in terms of a fan beam collimator, the same principles can be used for a parallel beam collimator simply by making the slits 3 in the plates 1 orthogonal to the edges of the rectangular plates 1.

In preparing the plates 1 and 2, according to the method of the invention, there is performed a cutting step of cutting a lead plate with 0.1 to 0.2 mm thickness to a size of 200 to 400 mm long and 10 to 50 mm wide or 200 to 500 mm long and 10 to 50 mm wide to provide the rectangular plates 1 and 2, an etching step of forming a taper as shown in FIG. 7*a* at the bottom portions and both end portions of the cut rectangular plates 1 and 2 by a chemical corrosion treatment, for example, and a slit forming step of forming the slits 3 in that side of the rectangular plate 1 which is opposite to the taper-formed side and forming the slits 4 in the taper-formed side of the rectangular plate 2 by wire electric discharge machining to provide the comb-shaped plates 1 and 2. The slits 3 are inclined at inclination angles $\theta 1$, $\theta 2$, . . . with respect to the width direction of the perforated collimator 14 in association with the inclination of the axes 16 of the holes 15 of the collimator 14, as shown in FIG. 8 which exaggeratedly shows the focusing of the fan beam collimator of the first embodiment. The slits 4 coincide with the width direction of the rectangular plate 2. Further, as shown in FIG. 7*b*, the comb elements 5 defined by the slits 3 are tapered at the tips thereof, as typically are the comb elements formed in plate 2, to facilitate meshing engagement of the plates 1, 2.

With respect to the forming of the frame shown in FIGS. 3–4, the method of the invention includes a step of forming the box frame 9 of tungsten (W) or lead alloy, which does not pass radiation, by wire electric discharge machining, and a step of forming the guide grooves 7 and 8 in the inner walls of the frame 9 by wire electric discharge machining. The end plate forming step includes a step of cutting out the end plate 12 of a square shape from an original material of aluminum (Al), which passes radiations, by wire electric discharge machining, and a step of forming the guide grooves 10 and 11 in a lattice form in the frame bottom element 12 by wire electric discharge machining. With the element 12 fitted in the box frame element 9, the individual guide grooves 10 extend to and communicate with the respective guide grooves 7 at the same inclination angle (see FIG. 9). Likewise, the individual guide grooves 11 are provided in the thickness direction to communicate with the respective grooves 8 (see FIG. 10). Further, the box assembling step includes a step of fitting the bottom portions and both end portions of the comb-shaped plates 1 in the guide grooves 7 and 10 formed in the inner walls of the box-shaped body 13, and a step of fitting the bottom portions and both end portions of the comb-shaped plates 2 in the guide grooves 8 and 11, while making the slits 4 of the comb-shaped plates and the grooves 3 of the comb-shaped plates 1 to engage with the box-shaped body 13, crossing one another. The guide grooves 8 have inclination angles $\theta 1$, $\theta 2$, . . . with respect to the grooves 3 of the comb-shaped plates 1.

The perforated collimator produced through the above steps comprises the box frame element 9 of a tungsten or lead alloys having a nearly square shape, the square frame bottom element 12 of Al securely fitted to one opening portion of the box frame element 9, and the comb-shaped plates 1 and 2, which have their bottom portions and both end portions fitted in the guide grooves 7, 8, 10 and 11 formed in the inner walls of the box-shaped body 13, formed by the box frame element 9 and frame bottom element 12 and engage with and cross one another through the slits 3 and 4 thereby to define the square holes 15 of a 0.5–2.0 mm side.

As the comb-shaped plates 1 and 2 are supported by the guide grooves 10 and 11, the perforated collimator 14 can prevent the assembling accuracy from being reduced by 0.1–1.0 mm warp caused at the time of forming the slits 3 and 4 in the comb-shaped plates 1 and 2. In a case where the comb-shaped plates 1 and 2 are fitted in the box frame element 9 without the element 12, depending on the material of the plates 1, 2, particularly where lead is used, due to the comb-shaped plates 1 and 2 being as significantly thin as 0.1 to 0.2 mm, their bottom portions cannot be aligned by their own stiffness alone. In one extreme case, the comb-shaped plates 1 and 2 might contact one another, so that the necessary focusing accuracy for the perforated collimator would not be obtained. According to this embodiment, however, both end portions as well as the bottom portions of the comb-shaped plates 1 and 2 are fitted in the guide grooves 10 and 11 arranged in a lattice form, thus ensuring alignment of the individual comb-shaped plates 1 and 2. The improvement of the assembling accuracy of the perforated collimator 14 together with the axes of the holes 15 of the perforated collimator 14 accurately crossing the focus line 17 at the right angles because of the guide grooves 8 and 11 and the grooves 3 of the comb-shaped plates 5 being formed in advance with inclination angles $\theta 1$, $\theta 2$, . . . can improve the focusing accuracy and provide the perforated collimator 14 with the desired resolution where lead alloy plates 1, 2 are used. The other fabrication methods, above described, however, are quite suitable where annealed tungsten plates 1, 2 are used.

In the method of producing a perforated collimator according to the above embodiment, if the comb-shaped plates 5 and 6 are 0.1 mm thick or thinner, an adhesive may be applied to the crossing portions of the plates to increase the stiffness so as to prevent reduction in the assembling accuracy due to some vibration. Further, although the exemplified perforated collimator of this embodiment is of a single focus point type in which the axes of the holes are normal to the focus line, this invention can also apply to a perforated collimator in which the axes of the holes are parallel to one another. Furthermore, the guide grooves 10 and 11 may be omitted.

According to the above-described method, a radiation transparent frame bottom element is provided at one opening edge portion of a box frame element of a perforated collimator, and comb-shaped plates that define holes for focusing radiations are fitted in guide grooves formed in the inner walls of the end plate and the frame, so that alignment of the comb-shaped plates can be done at high accuracy and high efficiency. Accordingly, it is possible to provide a perforated collimator with the desired resolution. Particularly, in a case where this invention is applied to producing a perforated collimator having the septa thickness of 0.2 mm or below and the holes of a 3 mm diameter or narrower, the above effect can be obtained without damaging the septa. In addition, in a case where the holes should be inclined so that their axes are normal to the focus line, as the assembling error does not occur, the resolution of the perforated collimator would not be reduced. Furthermore, the end plate can align and hold the comb-shaped plates as well as can serve as an outer plate.

A second preferred embodiment of the collimator of the present invention will now be described with reference to FIGS. 11 through 16.

Figure 13:
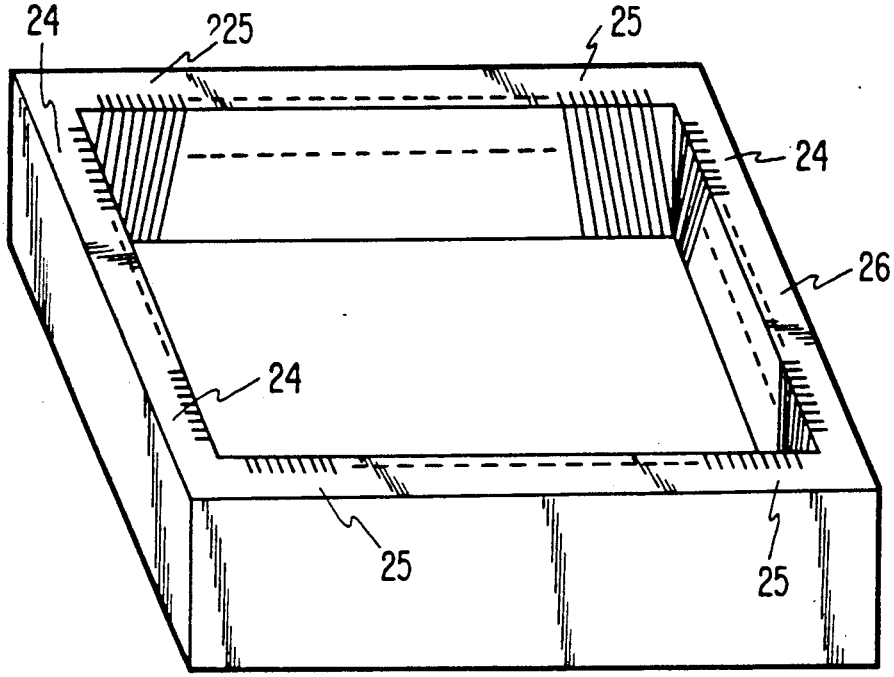
Figure 15:
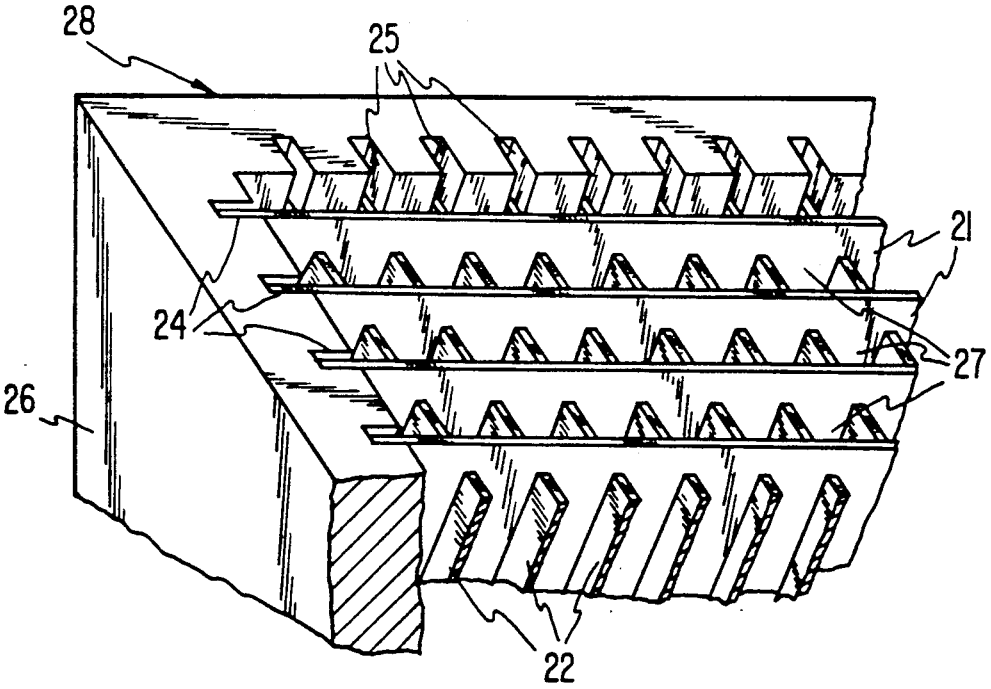
Figure 16:
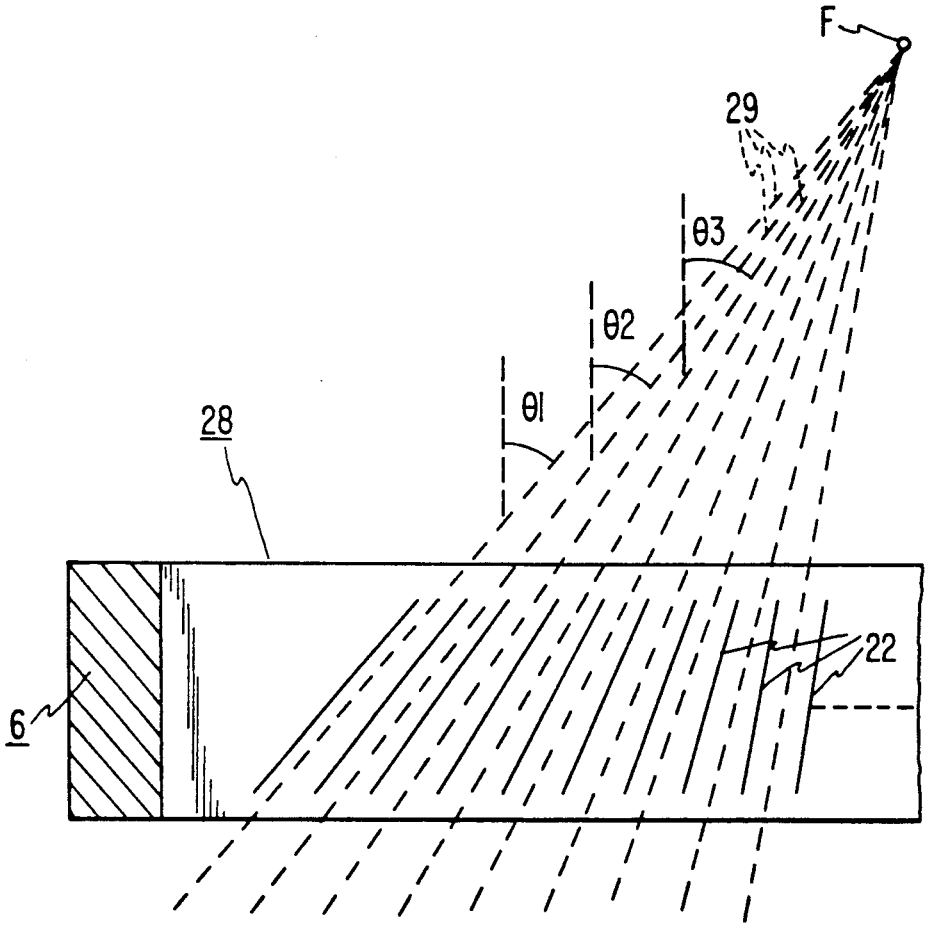

The perforated collimator of the second embodiment is produced by a method including a first punching step (see FIG. 11) of press punching first partition plates 21, 200–400 mm long and 45–50 mm wide from a sheet-like lead member having a thickness of 0.05 mm to 1 mm and containing niob by 5%, a second punching step (see FIG. 2) of press punching second partition plates 22, 200–500 mm long and 35–40 mm wide from a sheet-like member, 1 mm to 1.5 mm thick, acquired by cold rolling, a third punching step of press punching slit holes 23, 0.1 mm to 0.2 mm wide, through the first partition plates 21 obtained in the first punching step in such a way that their lengthwise direction nearly coincides with the width direction of the first partition plates, a box frame forming step (see FIG. 13) of forming a rectangular box frame element 26 having several hundred first and second guide grooves 24 and 25 formed, by wire electric discharge machining, in the inner wall thereof in which the first and second partition plates 21 and 22 are fitted, a partition-plate assembling step (see FIG. 14) of fitting the second partition plates 22 into the holes 23 of the first partition plates 21 to make a lattice engagement to form square holes with a 0.5–2.0 mm thick, and a box assembling step (see FIG. 15) of fitting both end portions of the first and second partition plates 21 and 22 assembled in the partition-plate assembling step, in the guide grooves formed in the inner walls of the box frame 26. In the third punching step, as shown in FIG. 13, the punched holes 23 are inclined in the lengthwise direction in such a way that their inclination angles gradually become smaller by $\theta 1$, $\theta 2$, . . . in association with the inclination of the axes 29 of 2000 to 4000 holes 27 of the perforated collimator 28, arranged in a honeycomb shape. The lengthwise direction of the first guide grooves 24 in which both end portions of the first partition plates 21 are to be fitted, are normal to the opening edge portion of the box frame element 26 or coincides with the height direction of the box frame element 26. The second guide grooves 25 in which both lengthwise end portions of the second partition plates 22 are to be fitted are inclined in association with the inclination angles $\theta 1$, $\theta 2$, . . . of the holes 23.

As shown in FIGS. 11 through 16, the perforated collimator 28 produced by the method according to the above embodiment includes the box frame element 26 of tungsten or lead alloy, which has a nearly square outline, and the first and second partition plates 21 and 22, which have their both end portions fitted in the first and second guide grooves 24 and 25 formed in the inner walls of the frame element 26 to engage with and cross one another in a lattice form through the holes 23, thereby forming the square holes 27 having a side 0.5–2.0 mm long.

According to the perforated collimator 28 of this embodiment, the first and second partition plates 21 and 22, i.e., the septa, 0.2 mm thick or thinner, and the inclination angles $\theta 1$, $\theta 2$, . . . of the second partition plates 22 can be accurately set by the holes 23, so that the axes 29 of the holes 27 of the perforated collimator 28 can surely cross the focus line (F) at the right angles, thus permitting the perforated collimator 28 to have a high resolution. If the partition plates are damaged at the time of assembling or after the assembling is completed, only those partition plates 22 which have been damaged have to be replaced, thus facilitating the repair and maintenance.

The method of producing a perforated collimator according to this second embodiment includes press-punching the first and second partition plates 21 and 22, boring the holes 23 in the first partition plates 21 by press punching, and assembling the first and second partition plates 21 and 22 through the holes 23, so that the working efficiency is significantly improved, as compared with a case of using the conventional casting method, or wire electric discharge machining (WEDM), and the manufacturing yield is also improved, thus ensuring reduction in the manufacturing cost. Further, since it is possible to make the first and second partition plates 21 and 22 as thin as about 0.05 mm, the punching punch rarely is broken, thus increasing the life of the punch. In this case, however, the wider the holes 23, the more the breaking of the punch can be prevented; therefore, it is desirable that the second partition plates 22 be thicker than the first partition plates 21. With the first partition plates 21 being 0.08 mm thick, it is desirable that the second partition plates 22 be about 0.12 mm thick.

Although the first and second partition plates 21 and 22 of the perforated collimator of the above embodiment are formed by press punching, they may be formed by another method, such as the wire electric discharge machining (WEDM) or the normal electric discharge machining (EDM). Further, as shown in FIG. 17, frame bottom element 30 of aluminum (Al) may be securely fitted in one opening portion of the box frame element 26, with the bottom portions of the first and second partition plates 21 and 22 being fitted in guide grooves 31 formed in this frame bottom element 30. This arrangement can improve the assembling accuracy and rigidity compared with a case using no bottom element 30, which contributes to improved resolution. Although the exemplified perforated collimator of the above embodiment is of a single focus type in which the axes 29 of the holes 27 are normal to the focus line (F), this invention can apply to a perforated collimator in which the axes of the holes are parallel to one another.

In addition, in the perforated collimator producing method of the above-described second embodiment, an adhesive may be applied to the crossing portions of the first and second partition plates 21 and 22 to provide such a rigidity as to prevent reduction in the assembling accuracy due to some vibration. Further, the first partition plates 21 and the slit holes 23 may be formed by press punching at the same time.

According to the perforated collimator of this second embodiment, the septa are 0.2 mm thick or thinner, and the axes of the holes of the perforated collimator can be set, as designed, by the slit holes, so that the produced perforated collimator can have a high resolution. If the partition plates are damaged at the time of assembling or after the assembling is completed, only those partition plates 2 which have been damaged need be replaced, thus facilitating repair and maintenance.

The method of producing a perforated collimator according to this second embodiment includes press-punching the first and second partition plates, boring the slit holes in the first partition plates by press punching, and assembling the first and second partition plates through the slit holes, so that the working efficiency is significantly improved, as compared with a case of using the conventional casting method or wire electric discharge machining (WEDM). In addition, the manufacturing yield is also improved, thus contributing to reduction in the manufacturing cost.

A third preferred embodiment of the present invention will now be described with reference to the FIGS. 18–40.

Figure 18A:
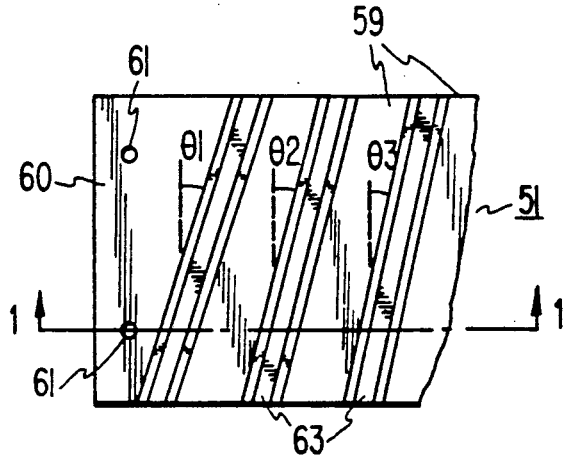
Figure 18B:
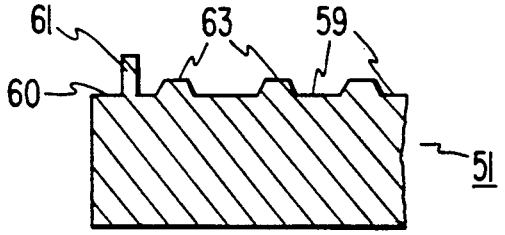
Figure 19A:
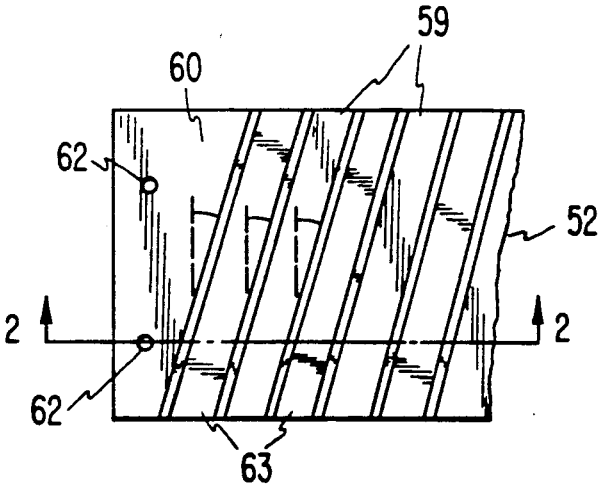
Figure 19B:
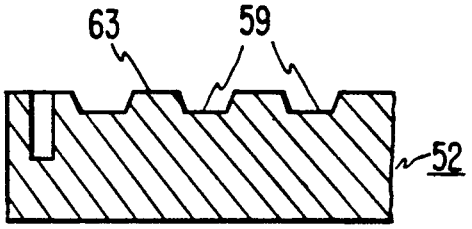
Figure 20:
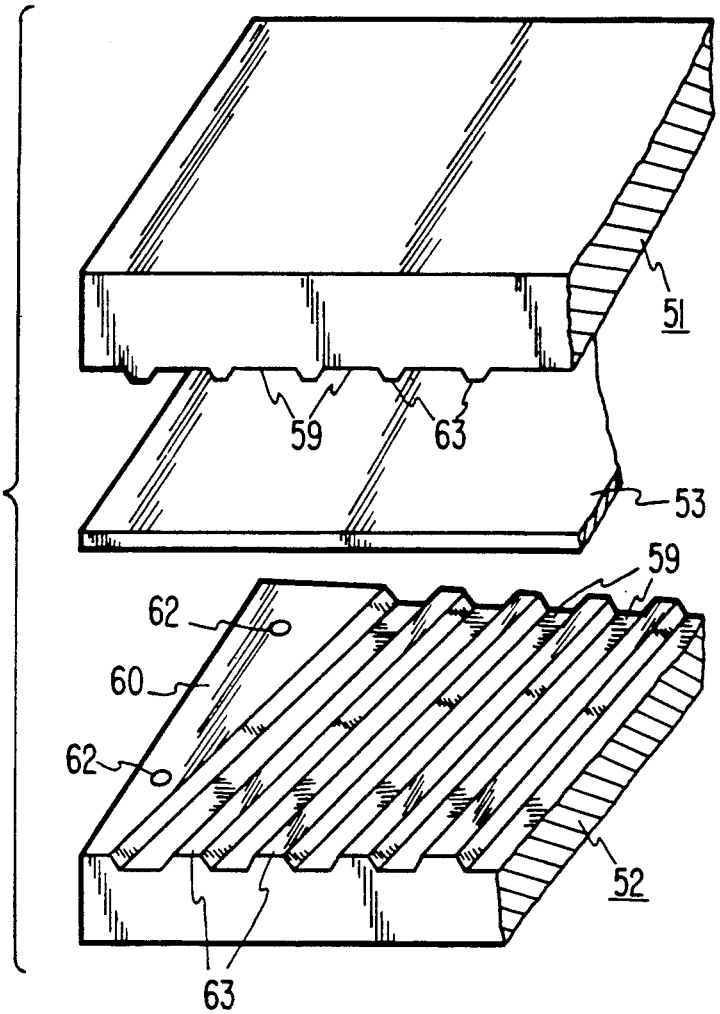
Figure 21:
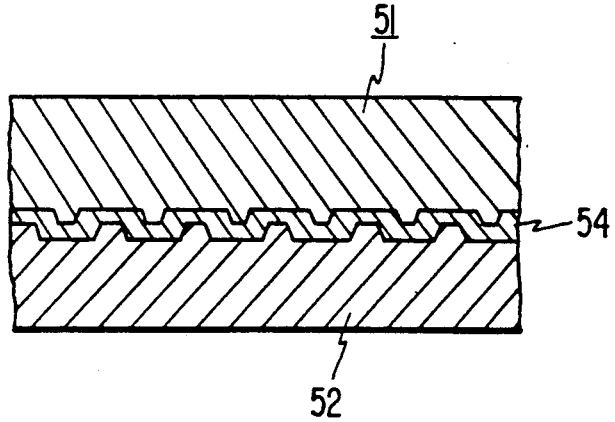
Figure 23:
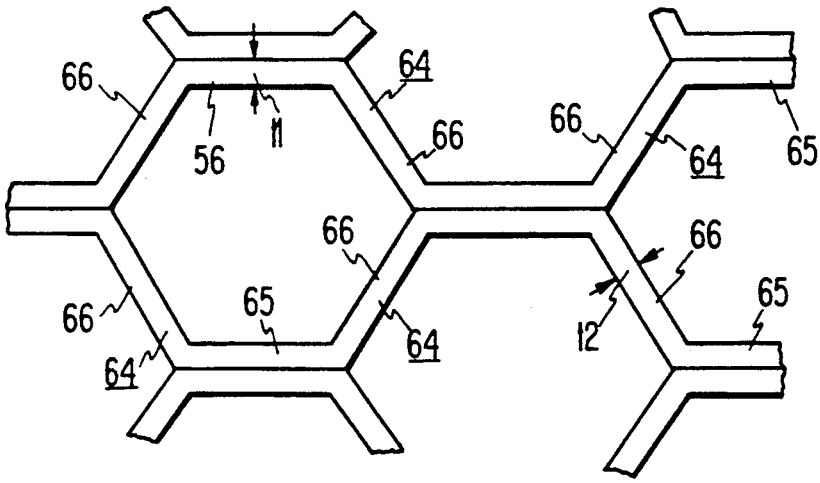
Figure 22:
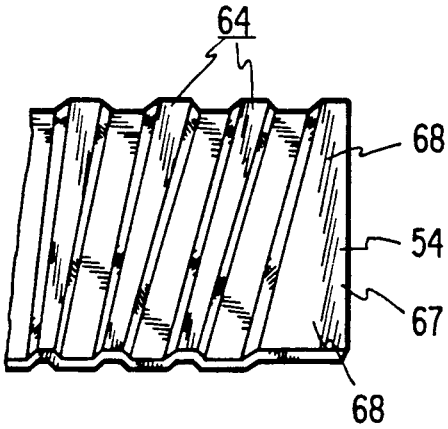
Figure 26:
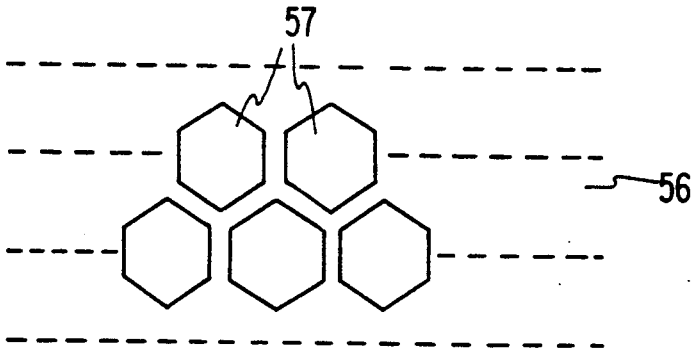
Figure 27:
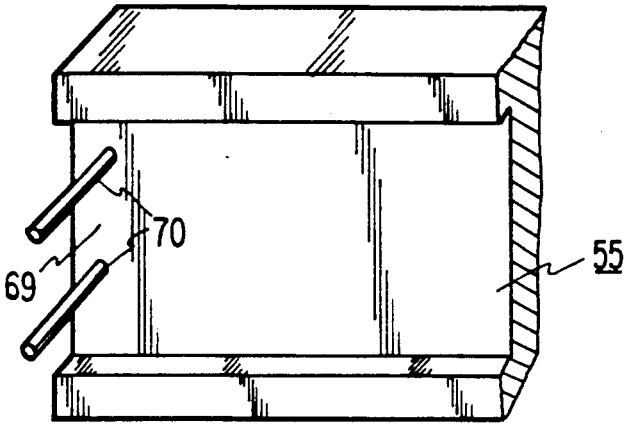

The third embodiment of a collimator is produced according to a method including a press working step of forming a pressed article 54 (see FIGS. 22 and 23) by press-working a 0.1 mm thick lead plate 53 using top and bottom molds 51 and 52 (see FIGS. 18 and 19) as shown in FIG. 20, an assembling step (see FIG. 23) of stacking a plurality of (for example, 300) pressed articles 54, prepared by the press working step, using a positioning jig 55 and adhering the contacting portions, and a sizing step (see FIGS. 24 and 25) of cutting both width-directional end faces of a product assembled by the assembling step by a wire electric discharge machine (not shown) to provide a collimator 56. FIGS. 18B and 19B are cross-sectional views in the arrowhead direction along the lines I—I in FIG. 18A and along the lines II—II in FIG. 19A, respectively. The lead plate 53 has a rectangular shape, 50 mm wide and 500 mm long, for example. The molds 51 and 52 have grooves 59 formed therein which have inclination angles $\theta 1$, $\theta 2$, . . . associated with the inclinations of the axes 58 of holes 57 of the collimator 56. A flat portion 60 is formed at either lengthwise end portion of that surface where the grooves are formed. Pins 61 are put upright in the flat portions 60 of the top mold 51, and the flat portions 60 of the bottom mold 52 have holes 62 formed therein where the pins 61 are to be fitted when the molds 51 and 52 are put closely together. The holes 57 of the collimator 56 are arranged in a honeycomb shape as shown in FIG. 26. The grooves 59 formed in the molds 51 and 52 have an inverted trapezoidal cross section, so that between the grooves 59 are undulation portions 63 having a trapezoidal cross section. The press working step includes a step of positioning the lead plate 53 on the bottom mold 52, and a step of lowering the top mold 51 toward the bottom mold 52 to closely put them together and press-working the lead plate 53 as shown in FIG. 21. The pressed articles 54 have such a cross section that trapezoidal portions 64 are formed in a zigzag as shown in FIG. 23. A top portion 65 has a thickness t1 of about 0.05 mm, for example, and a side portion 66 has a thickness t2 of about 1 mm, for example. Both lengthwise end portions of the pressed article 54 are flat plate portions 67 having positioning holes 68 bored by the aforementioned pins 61. The positioning jig 55 used in the next assembling step has a portion 69 that holds the pressed articles 54 fitted thereon, as shown in FIG. 27. Positioning pins 70 are put upright in both lengthwise end portions of the bottom of the portion 69. In the assembling step, about 300 pressed articles 54 are fitted over the positioning pins 70 through the positioning holes 68 and stacked. The stacking is performed while the articles are adhered by an instantaneous adhesive, with the top surface of one article on the bottom surface of another. The thickness of the adhesive should be set 0.05 mm or less.

According to the described collimator producing method, half portions of the holes 57 of the collimator 56 are formed in a single lead plate 53 by press working, and a plurality of the pressed lead plated 53 are stacked with a pair of pressed lead plates 53 being put together to form the holes 57. Therefore, the thicknesses of the septa that define the holes 57 can be set 0.2 mm or less without damaging the septa. In addition, the inclinations of the axes 58 of the holes 57 are the inclination angles $\theta 1$, $\theta 2$, . . . of the grooves 59 transferred as they are, so that the axes 58 can be set to be surely normal to a focus line 71 shown in FIG. 25, thus ensuring the desired resolution.

In the press working step, flat plate portions 72 may be provided on the pressed articles 54 in the width direction, as shown in FIG. 28. This can improve the rigidity of the articles 54 to prevent deformation in the assembling step. Further, providing positioning holes 73 in the flat plate portions 72 can improve the positioning accuracy at the time of assembling the collimator. Furthermore, providing beads on the flat plate portions 67 can further increase the rigidity. The rigidity and strength of the articles can be increased by using an instantaneous adhesive and an adhesive having a high adhesive strength together at the time of stacking and adhering the pressed articles.

A description will now be given of another embodiment of a collimator producing method according to this invention. This method includes an adhesive-film adhering step (see FIG. 29) of adhering adhesive films 81, for example, 0.01 mm thick, on one major surface of a rectangular lead plate 80, 0.1 mm thick, about 400 mm long and about 50 mm wide, for example, in a stripe form, a stacking step (see FIG. 30) of then stacking about 300 lead plates 80 with the adhered adhesive films 81, a pulling-plate forming step (see FIG. 30) of then adhering a pulling plate 82 of duralumin or molybdenum, worked through etching to have a thickness of about 0.2 mm and have the same shape as the adhesive films 81, to rubber plates 83 having substantially the same shape as the stacked lead plates 80 and a thickness of, for example, 3.5 mm, a pulling-plate adhering step (see FIG. 30) of then adhering the pulling plates 82 adhered to the rubber plates 83, to the associated adhesive films 81, a pulling step (see FIG. 31) of adsorbing vacuum chucks (not shown) to the rubber plates 83, and pulling the rubber plates 83 in the arrowhead directions **84*a* and 84*b* through the vacuum chucks to form the aforementioned collimator 56, and a step of then removing the pulling plates 82 and 83 by a wire electric discharge machine (not shown). FIG. 29B is a cross-sectional view in the arrowhead direction along the line III—III in FIG. 29A. The adhesive used in the adhesive-film adhering step is of, for example, an epoxy base and is applied by a printing method. At this time, both lengthwise end portions of the lead plate 80 are flap plate portions 85 having positioning holes 86 bored therein. The inclination angles $\theta 1$, $\theta 2$, . . . of the adhesive films 81 correspond to the inclinations of the axes 58 of the holes 57 of the collimator 56. Further, the adhesive films 81 on the top and bottom surfaces of the stacked lead plates 80 are shifted by a half pitch from each other. The stacking step uses the positioning jig 55 (see FIG. 27) used in the prior embodiment. The lead plates 80 are adhered by the adhesive films 81 every time each plate is stacked. The pitch of the pulling plates 82 is set equal to that of the adhesive films 81, through which the pulling plates 82 are adhered to the lead plates 80. In the pulling step, those portions of the lead plates 80 where the adhesive films 81 are not adhered are rotated about 60 degrees by the applied pulling force to thereby define substantially-hexagonal through holes 87**.

As described above, according to the latter embodiment of the collimator producing method, a plurality of lead plates 80 are assembled through the adhesive films 81 provided in association with the individual holes 57 of the collimator 56, and are then pulled in the stacking direction thereby to provide the collimator 56, so that the thicknesses of the septa that define the holes 57 can be set 0.2 mm or less without damaging the septa. Further, since the inclinations of the axes of the holes 57 are determined by the inclinations of the adhesive films 81, the axes 58 can be set to be surely normal to the focus line 71, thus providing the desired resolution.

In this latter embodiment, although the adhesive films 81 are adhered in a previously-inclined state, the collimator 56 can be provided by adhering the adhesive films 81 to the lead plate 80 in a direction normal to the lengthwise direction thereof as shown in FIG. 32 and stacking the lead plates 80 in the above-described manner, and pulling the lead plates 80 in the direction of the arrow 88 and rotating the plates in the direction of the arrow 89 at the same time, as shown in FIG. 33.

A description will now be given of yet another embodiment of a collimator producing method. The collimator produced according to this embodiment is very similar to that of the first embodiment.

This embodiment includes a comb-shaped plate producing step (see FIGS. 34 and 35) of forming linear slits 92 and 93, in rectangular plates 90 and 91 made of lead and having a thickness of 0.1 to 0.2 mm by wire electric discharge machining, for example, a box frame forming step (see FIG. 36) of forming a box frame 98 having several hundred guide grooves 96 and 97 formed in which comb-shaped plates 90 and 91 are fitted, and a box assembling step (see FIG. 37) of fitting the comb-shaped plates 90 and 91 in the box frame 98. The comb-shaped plate producing step comprises a cutting step of cutting a rectangular plate 90 to a size having a length of 200 to 400 mm and a width of 10 to 50 mm, and cutting a rectangular plate 91 to a size having a length of 200 to 500 mm and a width of 10 to 5 mm, a step of forming a taper as shown in FIG. 38 at the bottom portions of the cut rectangular plates 90 and 91 by a chemical corrosion treatment, for example, and a groove forming step of forming the slits 92 in that side of the rectangular plate 90 which is opposite to the taper-formed side and forming the slits 93 in the taper-formed side of the rectangular plate 91. The slits 92 are inclined at inclination angles $\theta 1$, $\theta 2$, . . . with respect to the width direction of the collimator 56 in association with the inclination of the axes 58 of the holes 57 of the collimator 56. The slits 93 coincide with the width direction of the rectangular plate 52. The frame forming step comprises a step of forming the box frame 98 of tungsten (W) or lead alloy by wire electric discharge machining, and a step of forming the guide grooves 96 and 97 in the inner walls of the frame 98 by wire electric discharge machining. The comb-shaped plates 90 are to be fitted in the guide grooves 96, and the comb-shaped plates 91 are to be fitted in the other guide grooves 97. The guide grooves 97 have inclination angles $\theta 1$, $\theta 2$, . . . with respect to the grooves 92 of the comb-shaped plates 90. Further, the box assembling step comprises a step of sequentially fitting the comb-shaped plates 90 in the guide grooves 96 formed in the box frame 98, and a step of fitting the comb-shaped plates 91 in the slits 92 of the comb-shaped plates 90 and the guide grooves 97 of the box frame 98. Upon completion of fitting the comb-shaped plates 90 and 91, the collimator 100 is provided (see FIG. 37). The collimator 100 has holes 101 defined in a lattice form by the comb-shaped plates 90 and 91 and having a square cross section. In this case, the septa thickness is 0.2 mm or less (e.g., 0.1 mm).

According to this latter embodiment of the collimator producing method, several hundreds comb-shaped plates 90 and 91 are assembled in a lattice form, so that the collimator can be assembled at high accuracy and high efficiency. Particularly, since the slits 92 and the guide grooves 97 are inclined in advance by inclination angles $\theta 1$, $\theta 2$, . . . , the axes of the holes 101 of the collimator 100 can be set normal to the focus line, thus ensuring the desired resolution.

In this latter embodiment, providing guide tongues 103 at lower portions of both ends of the comb-shaped plates 91 and fitting the plates 91 through these tongues 103 in the guide grooves 97 as shown in FIG. 39 can ensure the positioning, so that the plates can be smoothly fitted in the slits 92 of the comb-shaped plates 91. Further, an introducing portion may be provided by widening the end portions of the slits 92 of the comb-shaped plates 91 to produce tapered tips of the comb elements defined between slits 92, or making the corner portions thereof smoother.

The comb-shaped plates 90 and 91 may be assembled in separate box frames 110 and 111 and these frames 110 and 111 are connected through positioning pins 112 and positioning holes 113 to assemble a box, as shown in FIG. 40. This can significantly improve the box assembling efficiency. The box frame 111 alone may be removed after the box assembling is completed to provide a collimator. The introducing portion may be cut away if necessary.

Further, although the exemplified collimators of the latter described embodiments are of a single focus point type in which the axes of the holes of the collimator are normal to the focus line, this invention can also apply to a collimator in which the axes of the holes are parallel to one another. Likewise, the holes of the collimator are not limited to those of the above embodiments, and can be of a different type as long as the septa thickness is 0.2 mm or less and the diameter of the holes is 3 mm or less. Furthermore, the material for the plates is not limited to lead, and may be tungsten (W).

As described above, the collimator producing method of the present invention can efficiently produce collimators with the septa thickness of 0.2 mm or less and the hole diameter of 3 mm or less without damaging the septa. Particularly, in a case where the holes should be inclined so that the axes of the holes become normal to the focus line, the working error does not occur so that the resolution of the collimator would not be reduced and can have a value as designed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A collimator comprising:

a first array of plural radiation shielding longitudinally extending plates arranged parallel to each other and each having plural slits formed therein; and a second array of plural radiation shielding longitudinally extending plates arranged perpendicular to the planes of the plates of the first array and fitted in the slits of plates of the first array to define plural radiation passages between adjacent plates of the first array and adjacent plates of the second array;

wherein the slits of the plates of the first array are formed at predetermined angles selected so that upon intermeshing of the plates of the first and second arrays, said radiation passages are focused on a common focal line.

2. The collimator according to claim 1, wherein the plates of the second array each comprise plural slits and are intermeshed with the plates of the first array by means of the slits of the plates of the first and second arrays.

3. The collimator according to claim 1, wherein the slits of the plates of the first array are formed as holes in the plates of the first array, and the plates of the second array are arranged in respective corresponding holes of the plates of the first array.

4. The collimator according to claim 1, wherein the plates of the first and second array comprise a material selected from the group consisting of tungsten and lead.

5. The collimator according to claim 1, wherein the plates of the first and second arrays comprise:

lead loaded with carbon fibers.

6. The collimator according to claim 1, wherein the plates of the first and second arrays comprise:

a first radiation transparent material having laminated thereto a second radiation shielding material.

7. The collimator according to claim 1, further comprising:

a first frame element surrounding said array and made of a radiation shielding material.

8. The collimator according to claim 7, wherein said first frame element comprises plural grooves in which said plates of said first and second array are fitted.

9. The collimator according to claim 8, further comprising:

a second frame element made of a radiation transparent material and attached to said first frame element adjacent one side of said first and second arrays, said second frame element having plural grooves in which the plates of the first and second arrays are fitted.

10. The collimator according to claim 1, comprising:

a frame element on which said first and second arrays are mounted; and hardened lead clay introduced between plates of said first and second arrays at end portions of said plates.

11. The collimator according to claim 1, wherein said slits formed in at least the plates of one of said first and second arrays define comb elements having tapered tips between adjacent ones of said slits.

12. The collimator according to claim 1, wherein said plates of at least one of said first and second arrays have a tapered cross-section in a plane perpendicular to the plane of said plates at at least one edge portion thereof.

13. The collimator according to claim 11, wherein said slits formed in at least the plates of one of said first and second arrays define comb elements having tapered tips between adjacent ones of said slits.

14. A collimator comprising:

a first array of plural radiation shielding longitudinally extending comb-shaped plates arranged parallel to one another, each of the plates of the first array having plural slits extending from one plate edge of said plate to a predetermined distance at predetermined angles toward an opposite edge of said plate;

a second array of plural radiation shielding longitudinally extending comb-shaped plates, each of the plates of the second array having plural parallel slits extending from one plate edge a predetermined distance toward an opposite plate edge thereof; and the plates of the second array arranged orthogonal to the planes of the plates of the first array with the slits of the plates of the first array intermeshed with the slits of the plates of the second array to define plural radiation passages between adjacent plates of the first array and intermeshing adjacent plates of the second array;

wherein the predetermined angles of the slits of the plates of the first array are selected so that upon intermeshing of the plates of the first and second arrays, said radiation passages are focused on a common focal line.

15. The collimator according to claim 14, wherein the plates of the first and second array comprise a material selected from the group consisting of tungsten and lead.

16. The collimator according to claim 14, wherein the plates of the first and second arrays comprise:

lead loaded with carbon fibers.

17. The collimator according to claim 14, wherein the plates of the first and second arrays comprise:

a first radiation transparent material having laminated thereto a second radiation shielding material.

18. The collimator according to claim 14, further comprising:

a first frame element surrounding said arrays and made of a radiation shielding material.

19. The collimator according to claim 17, wherein said first frame element comprises plural grooves in which said plates of said first and second arrays are fitted.

20. The collimator according to claim 18, further comprising:

a second frame element made of a radiation transparent material and attached to said first frame element adjacent one side of said first and second arrays, said second frame element having plural grooves in which the plates of the first and second arrays are fitted.

21. The collimator according to claim 14, comprising:

a frame element on which said first and second arrays are mounted; and hardened lead clay introduced between plates of said first and second arrays at end portions of said plates.

22. The collimator according to claim 14, wherein said slits formed in at least the plates of one of said first and second arrays define comb elements having tapered tips between adjacent ones of said slits.

23. The collimator according to claim 14, wherein said plates of at least one of said first and second arrays have a tapered cross-section in a plane perpendicular to the plane of said plates at at least one edge portion thereof.

24. The collimator according to claim 21, wherein said plates of at least one of said first and second arrays have a tapered cross-section in a plane perpendicular to the plane of said plates at least one edge portion thereof.

25. A perforated collimator having a number of through holes formed side by side each for guiding and passing radiation from one end thereof to another end and focusing said radiations at a predetermined position, said collimator comprising:

a frame made of radiation shielding material and defining a radiation transparent field of view; and a septa section, provided in a lattice form in the field of view defined by said frame so as to define said through holes, said septa section including a plurality of first partition plates arranged at substantially equal intervals and a plurality of second partition plates crossing said first partition plates in a lattice form, said first and second partition plates being made of a radiation shielding material, a plurality of slit holes being formed at predetermined angles in at least either said first or second partition plates with the other partition plates being fitted in said slit holes;

wherein said predetermined angles are selected so that upon fitting of said second partition plates with the first partition plates, said through holes are formed focused on a common focal line.

26. A perforated collimator having through holes formed side by side for each guiding and passing radiations from one end to the other end and focusing said radiation at a predetermined position, said collimator comprising:

a frame made of a radiation shielding material and defining a field of view transparent to said radiation;

a frame bottom plate made of a radiation transparent material and fit adjacent a bottom of said frame and in said field of view, said other ends of said through holes opening adjacent to said bottom plate;

plate-shaped septa made of radiation shielding material and provided in a lattice form in said field of view defined by said frame and said bottom plate so as to define said through holes; and guide grooves, formed in an inner wall of said frame and said bottom plate, for receiving edge portions of said septa.

27. A method of producing a perforated collimator in which through holes each for guiding and passing radiation from one end thereof to another end and focusing said radiations at a predetermined position, are defined by plate-shaped septa made of a material for shielding said radiation, said method comprising:

a first assembling step of fitting a bottom plate made of a radiation transparent material in a field of view portion of a radiation shielding frame to form a box-shaped body, said other ends of said through holes opening adjacent to said bottom plate;

a guide groove forming step of forming guide grooves in an inner wall of said bottom plate and said frame, which form said box-shaped body provided by said first assembling step, for receiving edge portions of said septa; and a second assembling step of fitting said septa into said grooves of said box-shaped body to assemble said septa in a lattice form thereby to define said through holes.

28. A method of producing a perforated collimator having a frame made of a radiation shielding material, and a septa section, provided in a lattice form in space defined by said frame so as to define a number of through holes for guiding and passing radiation, said septa section including a plurality of first partition plates arranged at substantially equal intervals and a plurality of second partition plates crossing said first partition plates in a lattice form, said method comprising:

a partition-plate forming step of forming, said first and second partition plates by press punching;

septa-section forming step of assembling said first and second partition plates formed by said partition-plate forming step to form said septa section; and a box assembling step of assembling said septa section formed by said septa-section forming step in said frame;

wherein a plurality of slit holes are bored at predetermined angles in at least either said first or second partition plates in said partition-plate forming step, and the other partition plates are fitted in said slit holes to form said septa section;

wherein said predetermined angles are selected so that upon fitting of the other partition plates in said slit holes, said through holes are formed on a common focal line.

* * * * *

UNITED STATES PATENT AND TRADEMARK OFFICE

CERTIFICATE OF CORRECTION

PATENT NO. : 5,099,134

DATED : March 24, 1992

INVENTOR(S) : Daisuke Hase et al.

It is certified that error appears in the above-identified patent and that said Letters Patent is hereby corrected as shown below: On the title page, Item [30]

The first and second foreign application priority data should be deleted.

Signed and Sealed this

First Day of June, 1993

*Attest:*

*Attesting Officer*

Michael K. Kirk

MICHAEL K. KIRK

*Acting Commissioner of Patents and Trademarks*